United States Patent [19]

Obrecht

[11] 4,304,071

[45] Dec. 8, 1981

[54] SAFETY DEVICE FOR SLIDING DOORS

[75] Inventor: Georges Obrecht, Grenoble, France

[73] Assignee: Poma 2.000 S.A, Fontaine, France

[21] Appl. No.: 119,941

[22] Filed: Feb. 8, 1980

[51] Int. Cl.[3] ..... E05F 15/14

[52] U.S. Cl. ..... 49/26; 49/27; 49/13; 49/368; 49/370

[58] Field of Search ..... 49/26–28, 49/13, 366, 368, 370; 200/61, 43

[56] References Cited

U.S. PATENT DOCUMENTS

| | | | |
|---|---|---|---|
| 3,429,073 | 2/1969 | Tucker, Jr. | 49/13 X |
| 4,051,336 | 9/1977 | Miller | 49/27 X |
| 4,111,405 | 9/1978 | Krelis et al. | 49/370 X |

FOREIGN PATENT DOCUMENTS

| | | | |
|---|---|---|---|
| 2107254 | 9/1972 | Fed. Rep. of Germany . | |
| 1465600 | 12/1966 | France . | |
| 2089278 | 1/1972 | France . | |
| 2335681 | 7/1977 | France . | |
| 1227198 | 4/1971 | United Kingdom | 49/28 |
| 1419079 | 12/1975 | United Kingdom | 49/28 |

*Primary Examiner*—Kenneth Downey

*Attorney, Agent, or Firm*—Stevens, Davis, Miller & Mosher

[57] ABSTRACT

A safety device for a vehicle sliding door which detects any obstacle hindering the door closing movement and which cannot injure a passenger struck by the door. The door closing force is limited to a non dangerous value and the door comprises a tongue groove joint surrounded by a flexible lip joint. An obstacle is first struck by the flexible lips and only after retraction of these lips by the tongue. The presence of this obstacle hinders the penetration of the tongue into the groove and the closing of the door.

6 Claims, 10 Drawing Figures

SAFETY DEVICE FOR SLIDING DOORS

This invention relates to a safety device for automatically controlled sliding doors, for example the doors of a transportation vehicle or train car, or the doors used in buildings or in elevators. It is a modern practice to interconnect the control for the vehicle driving system with the door operating motor so as the train or vehicle cannot start until the doors are closed. The doors are made so that they will not injure a passenger should they strike him in closing and it is conventional to use a pneumatic, optical or mechanical detector, secured to the door front edge so that as soon as the detector strikes or detects an obstruction it immediately reopens the door. Alternatively, a light ray beamed across the entrance to a photoelectric sensitive receiver may be provided, the interruption of the light ray operates to stop and reopen the door. These safety edge or photoelectric detectors are not reliable. Further a passenger may easily reopen the door by pushing or actuating the detector so that the time which a train must remain in the station is increased.

It is an object of this invention to provide an improved safety device which cannot be used as a door opening control device.

Another known device has a door operating device which applies only a limited effort which cannot injure a passenger struck or wedged by the door. This device has detectors for detecting an obstruction in the doorway but these detectors cannot detect a small obstacle such as a dog leash or a cloth part caught on the door.

It is another object of the invention to provide a safety device which detects an obstacle hindering the door closing movement and prevents starting of the train until the doors are fully closed and without wedging of an obstacle for instance a dog leash.

According to the invention, there is provided a tongue and groove joint, the tongue penetrating into the groove when the door is fully closed. A retractable sheath surrounds the tongue when the door is in the opened position and at the end of the closing stroke flexible lips of the sheath abut corresponding flexible lips mounted on the fixed part or on the other panel of the door to push back the sheath and to permit the penetration of the tongue into the groove and the closing of the door. A person struck by the flexible lips may easily extricate himself and the door moves further into the fully closed position. A small flexible obstacle wedged between the flexible lips is maintained stretched and hinders door closing in the hereafter described manner. The flexible lips provide advantageously a baffle joint. The clearance or gap of the tongue and groove joint is small so that it prevents the insertion of an obstacle together with the tongue into the groove when the door is closing.

The invention is particularly well suited for a vehicle having a two panel sliding door but it is clear that the invention can be used with a single panel door, a vertically operating door, a lift door, etc. and that the tongue may be secured either to the fixed or to the movable part of the door.

An embodiment of the invention is described below with reference to the accompanying drawings wherein.

Figure 10:
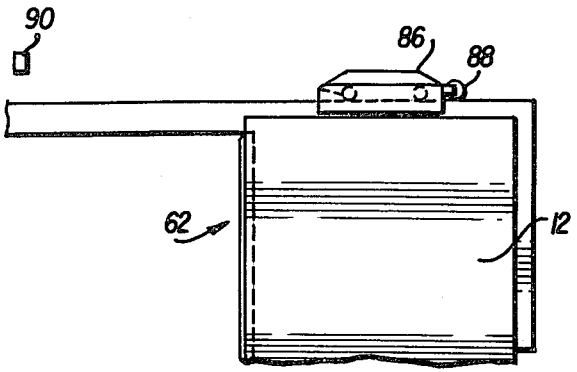
FIG. 10 is a partial diagrammatic elevation of a vehicle sliding door having the safety device shown in FIG. 1.

Referring to the drawings, a door has two panels 10, 12 only one 12 being shown in FIG. 10, adapted to move rectinearly and in opposite directions so as either to abut one another for the closed position of the door or to move away symmetrically from one another to open the door, for instance for entering or leaving a train vehicle. Each panel 10, 12 is top-hung and operated by a motor 86 and a friction wheel 88, the panel driving power being limited by the coefficient of friction of the friction wheels so that they will not injure a passenger hindering the panel movement. Other door operating motors or mechanisms may be employed such as a pneumatical actuator or a worm mechanism.

A metallic vertical U-shaped section 22 is fitted by clamps 20 to the side 18 of the edge 14 of panel 10. The section 22 extends along the whole height of panel 10 and its legs 24 define a vertical groove 26 opened towards the side of the opposite panel 12. Flexible lips 28, 30 are attached by dovetails 32 to the section 22 so as to surround the legs 24 and to project from the edge of the groove 26. It is easy to see that the flexible lips 28, 30 and the section 22 provide a flexible edge of the panel 10 having an inner rigid groove 26.

The base 40 of a metallic vertical T-section 38 is fitted by clamps 20 to the side 16 of the edge 36 of panel 12 so that the leg of the T section 38 protrudes as a vertical tongue 42 which penetrates into the groove 26 in the fully closed door position. A cone shaped cap 46 in plastic material covers the edge 44 of the tongue 42 and cooperates at the end of the closing stroke of panels 10, 12 with the chamfered edges 48 of section 22 for centering the panels 10, 12.

Guide slots 52, provided by stopped holes 50 bored in the tongue 42, extend in the travel direction of panel 12. A piston 54 having a rod 56 is slidably mounted in each slot 52 and a compression spring 58 guided by the rod 56 and bearing on a sleeve 60 of the side 16 biases the piston 54 into the slot 52.

A retractable sheath 62 is rigidly secured to the pistons 54 so as to surround the tongue 42. The sheath 62 comprises two cheeks 68, 70 secured by rivets 66 to flat outer faces 64 of the piston 54. The cheeks 68, 70 surround laterally the tongue 42 and their rear borders 72 overlap the side 16. The cheeks 68, 70 are fitted with flexible lips 74, 76 at their front edges 78, which, fitting close to the lips 28, 30 in the door closed position, prevent draughts. Bevelled edges 34, 78 of the lips 28, 30; 74, 76 provide a labyrinth seal which enhances the tightness of the joint. In the working position the sheath 62 covers the tongue 42 and its cap 46. It will be seen that at the end of the closing stroke the sheath 62 will be pushed back by the abutted lips 28, 30; 74, 76 into the retracted position, so that the tongue 42 protrudes and penetrates into the groove 26. In the retracted position the rear border 72 of the sheath 62 is advantageously flush with a frame. A door closure detector 90 is operated when the door is fully closed, the tongue 42 being inserted into the groove 26.

Figure 1:
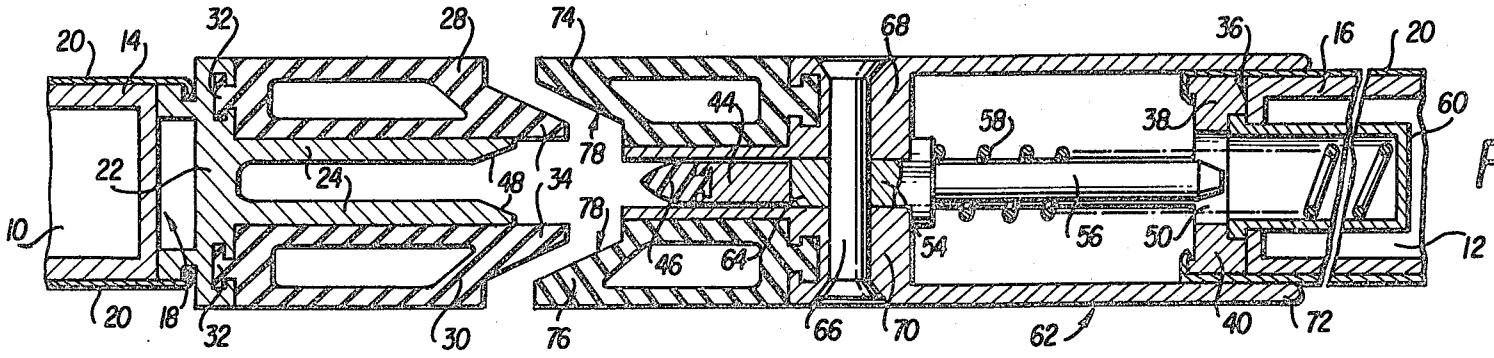
FIG. 1 is a partial plan view in cross-section of the safety device, shown with the door before closing.
Figure 2:
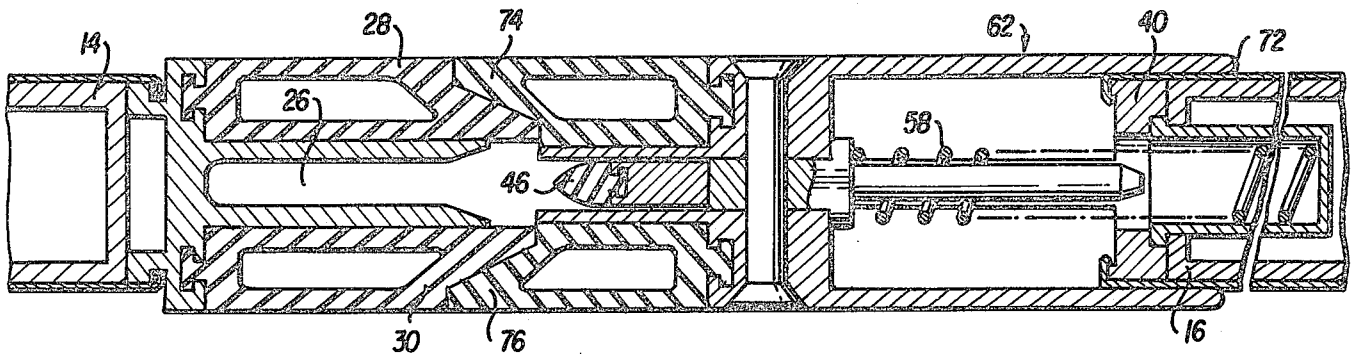
FIG. 2 shows the device of FIG. 1 with the door after engagement of the flexible lips.
Figure 3:
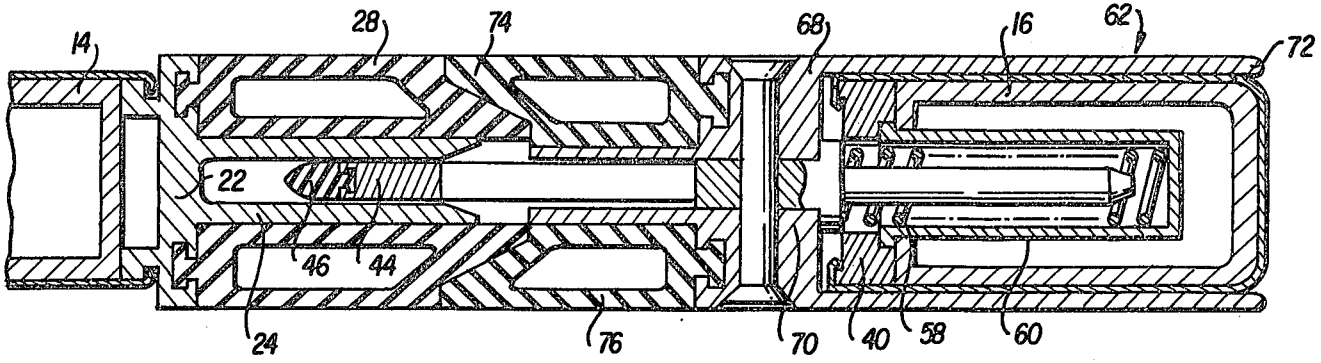
FIG. 3 shows the device of FIG. 1 with the door fully closed.
Figure 4:
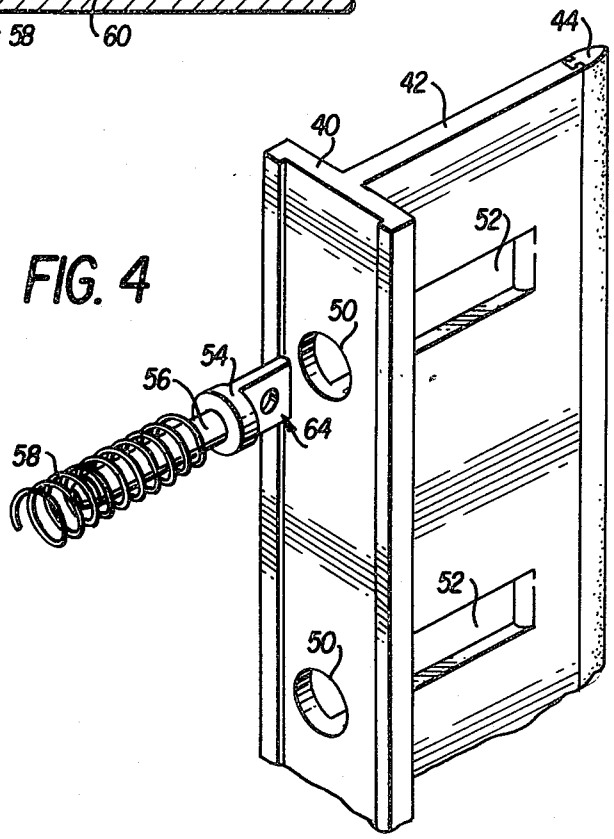
FIG. 4 is a perspective view of the tongue.

The safety device in accordance with the invention functions as follows:

In the opened position of the door the sheath 62 covers the tongue 42 (FIG. 1). When the door is closing and the elastic lips 28, 30; 74, 76 are about to abut (FIG. 2) the sheath 62 is pushed back against the spring 58 action. The door opening is closed by the abutted panels 10, 12 but the close door detector 90 is not operated and the motor 86 continues the closing movement until the tongue 42 penetrates into the groove 26 (FIG. 3). In the fully closed door position the detector 90 is operated and the train may start.

The door closing movement above described presupposes an unimpeded movement of the door panels 10, 12. If the flexible lips 28, 30; 74, 76 meet an obstruction the door closing movement is stopped.

Figure 5:
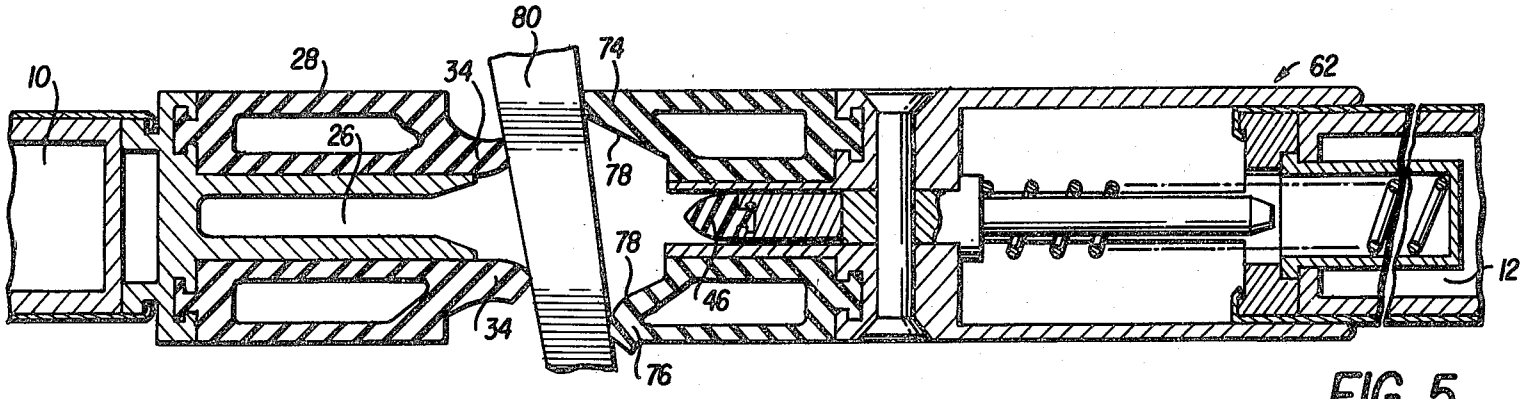
FIGS. 5 and 6 show the safety device respectively abutting and detecting a rigid obstacle.
Figure 6:
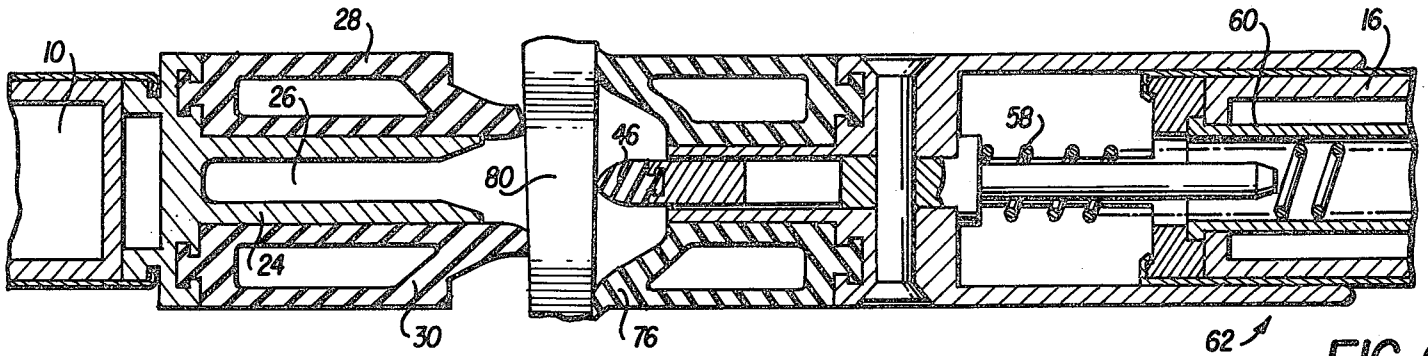

As shown in FIGS. 5 and 6, the door may strike a rigid obstacle 80. After the flexible deformation of the lips 28, 30; 74, 76 the sheath 62 is pushed back towards the retracted position and the tongue 42 abuts against the obstacle 80 preventing the closing of the door. The clamping force exerted by lips 28, 30; 74, 76 and the tongue 42 on the obstacle is limited to a non dangerous value and the passenger may extricate himself or draw out the obstacle to permit the door closing.

Figure 7:
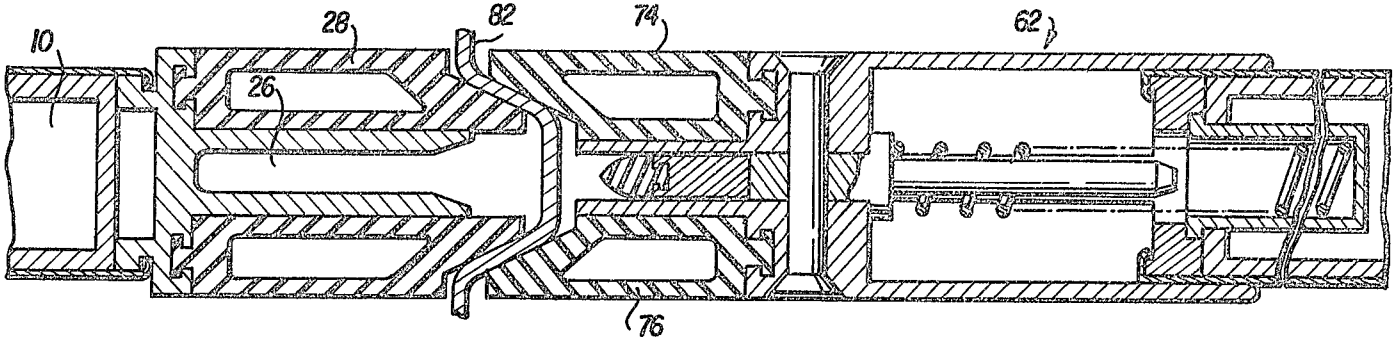
FIGS. 7 and 8 show the safety device respectively abutting and detecting a flexible obstacle.
Figure 8:
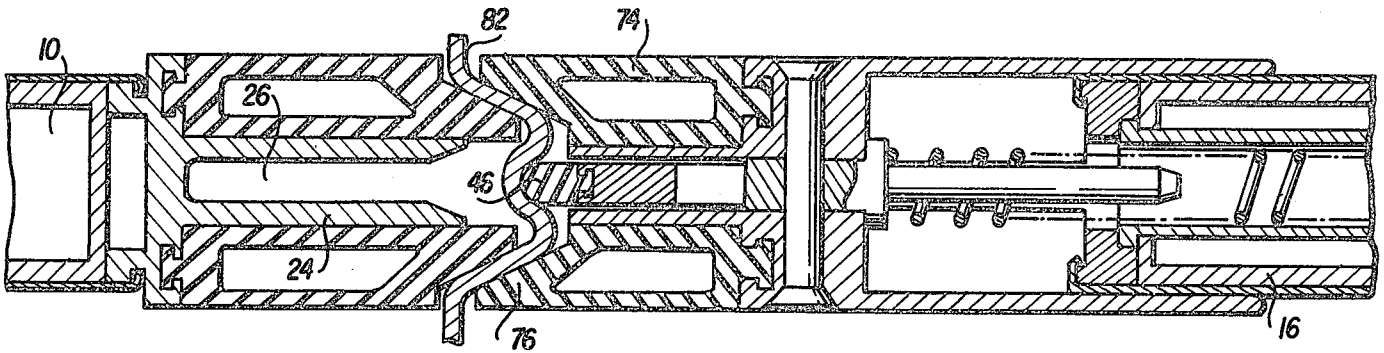

As shown in FIGS. 7 and 8, the door may strike a thin flexible obstacle 82. As soon as the lips 28, 30; 74, 76 engage the obstacle 82 the latter is deformed to extend along the labyrinth joint provided by the lips. Further movement of the door will move the tongue 42 in abutment of the locked obstacle 82 and the door closing is prevented in the above described manner.

Figure 9:
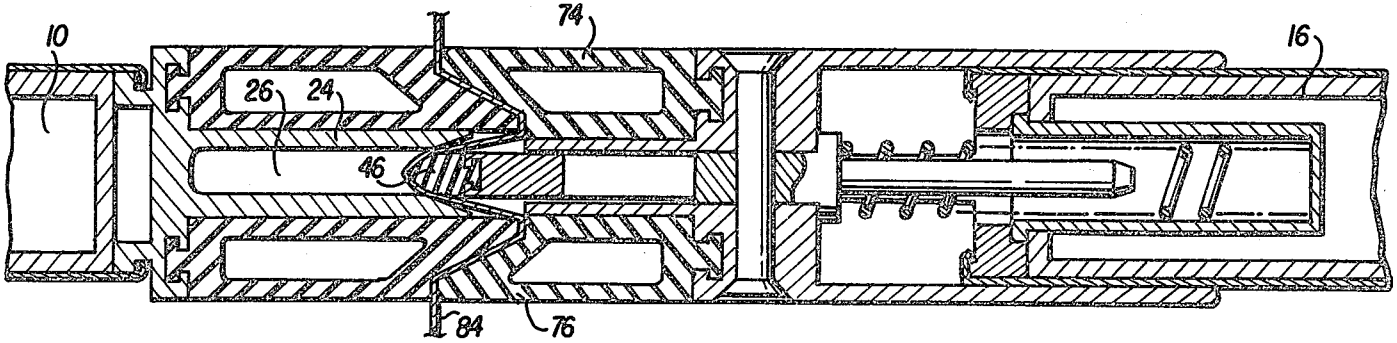
FIG. 9 shows the safety device detecting a flexible thin obstacle.

As shown in FIG. 9, the door may strike a thin flexible slippery obstacle 84. The clamping force of the lips 28, 30; 74, 76 does not prevent sliding of the obstacle 84 which is urged towards the left by the tongue 42. This tongue 42 may move further for a limited distance before it begins to penetrate into the groove 26, but the clearance or gap of the tongue groove joint 42, 26 may be arranged so that the tongue 42 surrounded by the obstacle 84 is prevented to move into the groove towards the fully closed door position.

When the closing operation is interrupted by an obstacle a delayed re-open instruction is given to the door in a well known manner.

The safety device according to the invention is very simple and it detects any kind of obstacles. Clearly, the invention is of use without modification to one or two panel doors. The flexible lip joint and the tongue groove joint provide enhanced watertightness.

What is claimed is:

1. In a sliding door mechanism having two sides which are closed together in an abutting relationship in response to the force from a motor, said motor having a force limiting means for preventing injury to a passenger caught between said sides, and having a door position detector for determining the presence or absence of a fully closed door, a safety device for controlling the closing movement of said door comprising:

a tongue groove joint between said sides, said joint comprising a tongue connected to one of said sides, and a groove connected to the remaining of said sides, said tongue and groove forming said joint during closure of said door;

a retractable sheath secured to said one side and movable with respect to said one side into a first protruded position wherein it surrounds said tongue, and into a second retracted position wherein it exposes said tongue to permit said tongue to enter said groove, said sheath being movable between said first and second positions by a force smaller than said closing force.

2. A safety device according to claim 1, said retractable sheath having flexible lips secured to its front edges so that an obstacle interposed between said two sides is initially struck by said lips and, only after retraction of said sheath, by said tongue.

3. A safety device according to claim 2, comprising a first pair of flexible lips disposed on each side of said tongue.

4. A safety device according to claim 3, comprising a second pair of flexible lips secured on each side of said groove for coming into abutment with said first pair of flexible lips in the closed door position.

5. A safety device according to claim 4, wherein said abutting flexible lips have bevelled edges providing a baffle joint in the closed door position.

6. A safety device according to claim 1, comprising a metallic U section secured to one of said sides so that the legs of the U section define said groove and a metallic T section secured to the other of said sides so that the leg of the T section provides said tongue of said tongue groove joint, the clearance between said tongue and said groove preventing the penetration of said tongue in the presence of an obstruction.

* * * * *